US006102730A

United States Patent [19]

Kjeldahl et al.

[11] Patent Number: 6,102,730

[45] Date of Patent: Aug. 15, 2000

[54] CONNECTOR ELEMENT FOR TELECOMMUNICATIONS

[75] Inventors: Poul Kjeldahl, Horsens; Lars Wedege, Skanderborg, both of Denmark

[73] Assignee: Cekan/CDT A/S, Gjern, Denmark

[21] Appl. No.: 09/188,984

[22] Filed: Nov. 9, 1998

Related U.S. Application Data

[63] Continuation-in-part of application No. 08/530,266, Sep. 1, 1995, abandoned.

[51] Int. Cl.[7] ..... H01R 4/24

[52] U.S. Cl. ..... 439/405; 439/676; 439/941

[58] Field of Search ..... 439/676, 941, 439/344, 404, 405, 409

[56] References Cited

U.S. PATENT DOCUMENTS

| | | | |
|---|---|---|---|
| 4,418,239 | 11/1983 | Larson et al. | 174/34 |
| 4,744,772 | 5/1988 | Reichardt et al. | 439/405 |
| 4,756,695 | 7/1988 | Lane et al. | 439/76 |
| 4,917,629 | 4/1990 | Matsuzaki et al. | 439/405 |
| 4,986,779 | 1/1991 | Ferrill et al. | 439/108 |
| 5,064,383 | 11/1991 | Locati et al. | 439/405 |
| 5,186,647 | 2/1993 | Denkmann et al. | 439/395 |
| 5,226,835 | 7/1993 | Baker, III et al. | 439/941 |
| 5,299,956 | 4/1994 | Brownell et al. | 439/941 |
| 5,326,286 | 7/1994 | Bixler et al. | 439/751 |

FOREIGN PATENT DOCUMENTS

| | | |
|---|---|---|
| 0 456 340 A2 | 11/1991 | European Pat. Off. . |
| WO 93/19500 | 9/1993 | WIPO . |

*Primary Examiner*—Gary F. Paumen
*Assistant Examiner*—Tho D. Ta
*Attorney, Agent, or Firm*—Wolf, Greenfield & Sacks, P.C.

[57] ABSTRACT

A connector element for telecommunications. The connector element includes a standardized group of contact terminals constructed to form a connection with corresponding terminals of a mating connector element. The connector element and the mating connector element together make up a connector for telecommunications. The connector element also includes a plurality of wire connector terminals, and leads that connect the contact terminals to the wire connector terminals. The leads are disposed and arranged in a three-dimensional manner, spaced not only laterally along the length of the connector, but also vertically. In one embodiment, the leads of the connector element are disposed and arranged so as to optimize the electrical transfer function of the connector by offsetting any coupling introduced by the mating connector element, so that the connector element when connected to the mating connector element forms a mated plug and jack connection having an optimized electrical performance.

37 Claims, 8 Drawing Sheets

CONNECTOR ELEMENT FOR TELECOMMUNICATIONS

This is a continuation-in-part of United States patent application Ser. No. 08/530,266, filed Sep. 1, 1995 abandoned, which entered national stage under 35 U.S.C. §371 from an International Application having an international filing date of Mar. 11, 1994 and a priority date of Mar. 12, 1993.

BACKGROUND OF THE INVENTION

1. Field of the Invention

The present invention relates to a connector for use in communication networks, including data transmission networks and, more particularly, to a connector element with its leads spaced and arranged to offset any coupling in a mating connector element of a connector to yield a reduced cross-talk connector.

2. Description of the Related Art

The traditional copper wires used in communication networks have been challenged by fiber optical wires, which provide for very high transmission capacity, that is the ability to conduct a very high number of bits per second. However, copper wire cables still have pronounced advantages, and copper wire cables have been developed with a noticeable increase in the transmission capacity. One problem with copper wire cables has been the electrical capacity or inductance between the wires in a bundle of wires making up the cable, in particular the cross-talk performance. The cross-talk between wires or pairs of wires in a cable is a source of interference that degrades the quality of the signal propagated by the cable, and ultimately manifests itself as increased error rate of the signal. However, good results in cross-talk performance of the cable have been achieved by different measures such as, for example, twisting of the wires.

Cross-talk occurs not only in the cables that carry the data signals, but also in connectors that are used to connect hardware such as, for example, a high-speed personal computer to the cables. Accordingly, it is common practice to have a telecommunications connector to make a connection between the hardware and the cable, which includes a number of wire pairs. These standard telecommunications connectors include two mating connector elements that are commonly referred to as plugs and jacks. It is also common practice in such communication systems, according to a pre-established standards for the connector and in particular, contact terminals of the connector, to configure the plugs and jacks with rows of the contact terminals which are connected with corresponding rows of wire connector terminals through parallel leads in the connector element. However, there is a certain capacitive coupling that exists between the leads of the connector element. Further, it is a desire that the connector be as small as possible, and this, of course, accentuates the capacitive coupling problem because the required small dimensions result in a small distance between the leads of the connector elements and thus a relatively high capacity between these leads.

In addition, while the capacity between neighboring conductors of a connector element may be relatively high, it may also be undesirably low between non-neighboring conductors of the connector element. Thus, the pre-established standard for the contact terminals does not create ideal conditions in the connector elements. In particular, problems occur not only with the capacity between the leads of the connector element, but also with respect to inductance of the leads themselves and mutual inductance between the leads; the inductance being a function of the width of the leads and the mutual inductance being a function of the coil affect between pairs of the leads. Accordingly, it is an object of the invention to provide an improved connector element and connector.

SUMMARY OF THE INVENTION

It is to be understood that according to this specification, a connector is a device that connects a transmission medium such as, for example, a communications cable to another communications device such as, for example, a personal computer. However, it is to be appreciated that variations apparent to one of skill in the art such as, for example, a connection between two communications cables are also within the scope of this definition. It is also to be understood that a connector is made of mating connector elements typically referred to as a plug and a jack, and therefore it is to be understood that a connector element according to this specification can be either one of a plug or a jack of a connector.

According to the present invention, one improved connector element for use in a high frequency communication network includes a plurality of contact terminals arranged in at least one plane configured for connection with corresponding terminals of a mating connector element, a plurality of wire connector terminals arranged in at least one plane, and a plurality of leads disposed and arranged in a three-dimensional manner. Each lead connects a corresponding wire connector terminal with a corresponding contact terminal. These elements are enclosed within a cast block member of a dielectric material which holds the leads in the three dimensional manner.

In one embodiment of the connector element, the leads extend from the contact terminal at a front of the connector element to the wire connector terminals. The leads spread away from each other along a length of the connector element, with some of the leads extending in a common plane, in which they divert laterally from each other, and with others leads extending in a diverging manner in another plane diverging from the common plane.

In another embodiment of the connector element, the wire connector terminals are arranged in two rows, with a first row disposed substantially at the rear of the connector element and a second row disposed between the first row and the contact terminals along the length of the connector element.

This connector element is provided with a mating connector element counterpart to form a connector for use in high frequency communication networks.

According to the present invention, another improved connector element for use in high frequency communication networks includes a standardized group of contact terminals at a first end of the connector element that are disposed and arranged to form a connection with corresponding terminals of a mating connector element counterpart, a plurality of wire connector terminals disposed at substantially a second end of the connector element, and a plurality of leads. Each lead connects a respective contact terminal to a corresponding wire connector terminal, such that the leads are spaced and arranged laterally and vertically along the length of the connector element, and such that the leads are shaped and mutually arranged so as to optimize the electrical transfer function of the connector element.

This connector element is provided with the mating connector element counterpart to form a connector for use in high frequency communication networks. The electrical transfer function of the connector element is optimized to offset any coupling introduced by the mating connector element counterpart. The resulting connector has an optimized return loss, an optimized insertion loss and an optimized cross-talk performance.

In one embodiment of the connector element, the wire connector terminals are located in two rows that have inverted U-shaped grooves disposed in a vertical manner, a first row being disposed in a first horizontal plane disposed above a second row in a second horizontal plane, and the second row being substantially at a second end of the connector element.

In another embodiment of the connector element, the wire connector terminals are located in two rows that have inverted U-shaped grooves disposed in a horizontal manner, one row being spaced above another.

In yet another embodiment of the connector element, the wire connector terminals are located in two rows that have inverted U-shaped grooves disposed in a vertical manner, wherein a first row is disposed above the second row and the inverted U-shaped grooves of the first and second row face away from another.

In another embodiment of the connector element, the contact terminals are arranged in at least two distinct planes.

According to the present invention, a method of optimizing an electrical transfer function of a communications network connector comprises the steps of measuring the return loss of the communications network connector and spacing and arranging leads of a connector element of the communications network connector so as to optimize the return loss of the communications network connector, and so as to offset any coupling introduced by a mating connector element of the communications network connector. The communications network connector comprises the connector element and the mating connector element. The connector element comprises a plurality of contact terminals at a first end of the connector element disposed and arranged to form a connection with corresponding terminals of the mating connector element, a plurality of wire connector terminals at substantially a second end of the connector element, and a plurality of leads wherein each lead connects a respective contact terminal to a corresponding wire connector terminal. With this method, the leads are spaced and arranged both laterally and vertically so as to optimize the electrical transfer function of the communications network connector by optimizing the return loss of the communications network connector.

Also, with this method, the communications network connector is provided with an optimized insertion loss, return loss and cross-talk performance.

Other objects and features of the present invention will become apparent from the following detailed description when taken in connection with the following drawings. It is to be understood that the drawings are for the purpose of illustration only and are not intended as a definition of the limits of the invention.

BRIEF DESCRIPTION OF THE DRAWINGS

The foregoing and other objects and advantages will be more fully appreciated from the following drawings in which.

DETAILED DESCRIPTION OF THE INVENTION

Figure 1:
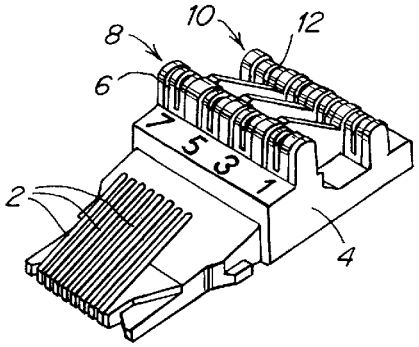
FIG. 1 is a perspective view of one embodiment of a connector element according to the invention.

It is to be understood that according to this specification, a connector is a device that connects a transmission medium such as, for example, a communications cable to another communications device such as, for example, a personal computer. However, it is to be appreciated that variations apparent to one of skill in the art such as, for example, a connection between two communications cables are also within the scope of this definition. It is also to be understood that a connector is made of mating connector elements typically referred to as a plug and a jack, and therefore it is to be understood that a connector element according to this specification can be either one of a plug or a jack of a connector.

A study of the interactions and of the different phenomena related to cross-talk between the leads of a connector has been performed. According to the invention, there is provided an improved, novel connector and connector element having improved electrical performance. In particular, as will be described in detail below, there is provided one embodiment of a connector element having a novel arrangement. In addition, according to the invention there are provided a plurality of embodiments of a connector element having its leads disposed and arranged so as to offset and thus electrically balance out any coupling introduced by a mating connector element, so that the overall connector comprising the connector element and mating connector element has reduced cross-talk between the leads of the connector, and so that when the connector element is connected with the mating connector element, the combined plug and jack connection has an optimized electrical performance. As will be discussed in further detail below, the reduced cross-talk between the leads of the connector is a result of any of an optimized capacity between the leads of the connector, an optimized inductance of the leads of the connector, an optimized mutual inductance between the leads of connector element, and arranging the leads of one connector element to offset any coupling introduced by the mating connector element.

According to the pre-established standards discussed above with respect to the related art, the contact terminals of the related art connector elements are normally arranged in rows. End portions of the leads are narrow and are located in the rows with small mutual spacing between them. However, the wire connector terminals of the connector element cannot possibly be correspondingly arranged, as they have to be much broader so as to, for example, accommodate the width of the wires. In a known connector as disclosed in U.S. Pat. No. 5,186,647 (hereinafter "Denkmann et al."), the wire connector terminals are disposed and arranged at both lateral sides of the connector. However, one problem with the arrangement of the wire connector terminals of Denkmann et al. is that the arrangement adds to the overall width of the connector. In contrast, according to one connector element of the invention, as a result of the spatial arrangement of the leads and wire connector terminals, it has been found possible to arrange these wire connector terminals without causing an increase in the width of the connector element and thus in the overall connector. For example, in one connector element of the invention discussed in detail below with respect to FIGS. 1–11, the wire connector terminals are arranged in two rows, a first row of wire connector terminals located at a first end of the connector element and a second row of wire connector terminals located along the length of the connector element. The first row of wire connector terminals may also be disposed in a first horizontal plane lower than the second row of wire connector terminals disposed in a second horizontal plane, whereby the total width of the connector element and connector can be kept small.

Accordingly, as will be discussed in detail below, each connector element and connector of the invention breaks with the traditional connectors having leads inside the connector extending substantially in parallel to each other between a row of contact terminals and a row of wire connector terminals. In each connector element of the invention, these leads are spaced and arranged generally in a three-dimensional manner, such that different leads are spaced not only laterally along a length of the connector element, but also vertically to the plane of the lateral spacing.

Figure 3:
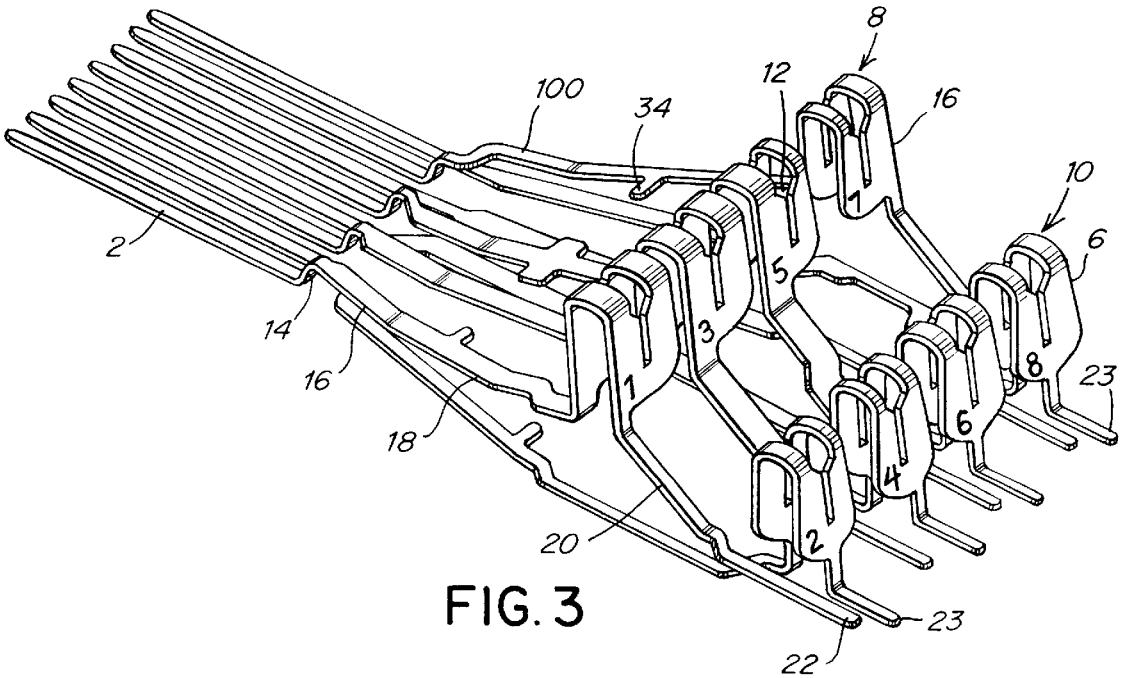
FIG. 3 is an enlarged perspective view of the connector element of FIG. 2, seen from a rear end thereof.
Figure 6:
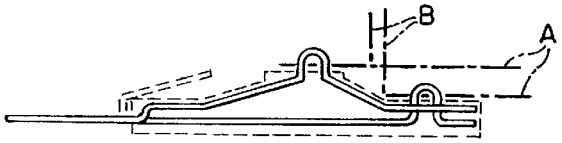
FIG. 6 is a side view of the leads, according to the connector element of FIGS. 2 and 3.

Turning now to a first connector element of the invention as illustrated in perspective view in FIG. 1, the connector element has eight contact terminals 2 protruding from a front end of the connector element and being bent-over into their operative positions as illustrated in FIG. 6. FIG. 6 illustrates a side view of the leads of the connector element in which the leads are shown in dotted lines in the bent-over position. The connector element also includes leads 100 that are cast into a plastic block member 4, as illustrated in a perspective view of the connector element in FIGS. 9 and 10. Referring again to FIG. 1, the contact terminals 2 are, respectively, connected via the leads 100 with individual wire connector terminals 6 that are arranged in two rows, with four wire connector terminals in each row; a first, foremost row 8 is disposed in front of a second rearmost row 10. Each of these wire connector terminals 6 has an inverted U-shaped terminal provided with a notch 12 for receiving a wire end. Referring to FIG. 3, which is an enlarged perspective view of the connector element from a rear view of the connector element, the wire connector terminals are marked with the odd indicia numbers 1–7 in the upper first row 8 and with even indicia numbers 2–8 at the lower second row 10.

Figure 2:
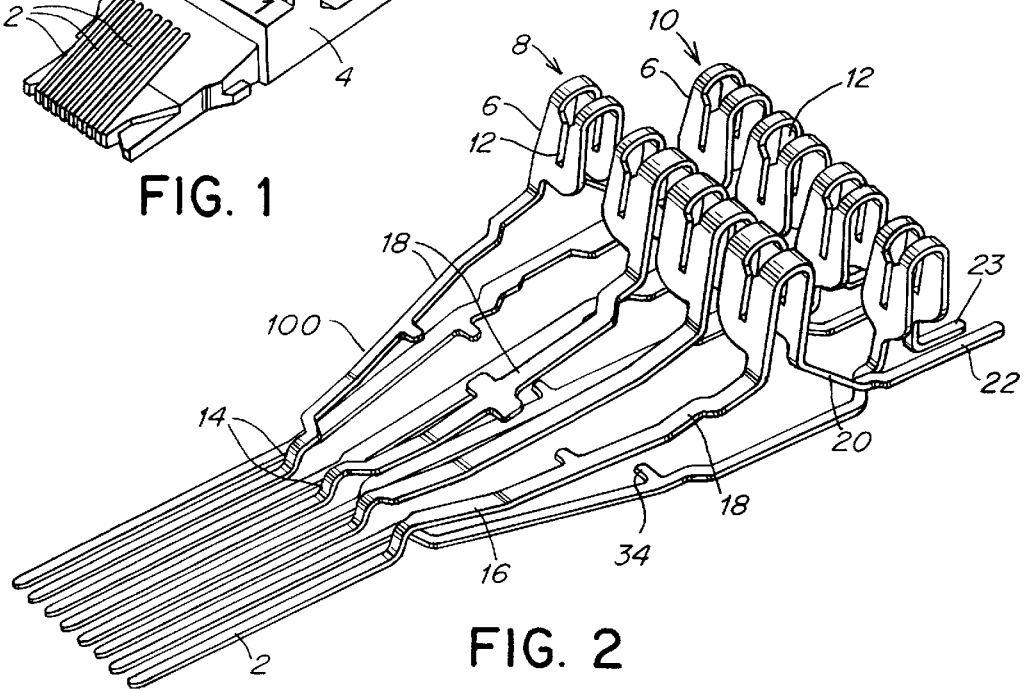
FIG. 2 is an enlarged perspective view of a connector element of FIG. 1, seen from a front end thereof.

FIG. 2, which is an enlarged perspective view of the connector element, and FIG. 3 illustrate the spacing and arrangement of the leads 100, as made ready for being cast into the block member 4. The leads 100 connecting the wire connection terminals 6 in the second row 10 with their associated contact terminals 2, extend in an horizontal plane from the forwardly projecting, not yet bent-over contact terminals 2. The inverted U-shaped wire connection terminals 6 are provided as bent-up portions of these leads 100. At their roots adjacent to the contact terminals 2, the remaining four leads 100 connecting the wire connector terminals 6 in the first row 8 and the contact terminals 2, are bent upwardly a short distance at lead portion 14, whereafter they extend rearwardly through a short horizontal portion 16 and then further through an upwardly inclined lead portion 18 to the inverted U-shaped member forming the associated wire connection terminal 6 in the upper first row 8. From the wire connection terminals 6 in the first row 8, the leads extend further rearwardly through a downwardly inclined lead portion 20 and a following, rear lead portion 22 that is substantially in a same plane as the foremost horizontal portion 10, and that is spaced above the plane of the lowermost leads 100. The lower second row 16 of wire connector terminals 6 also are provided with rearwardly projecting lead portions 23.

Figure 4:
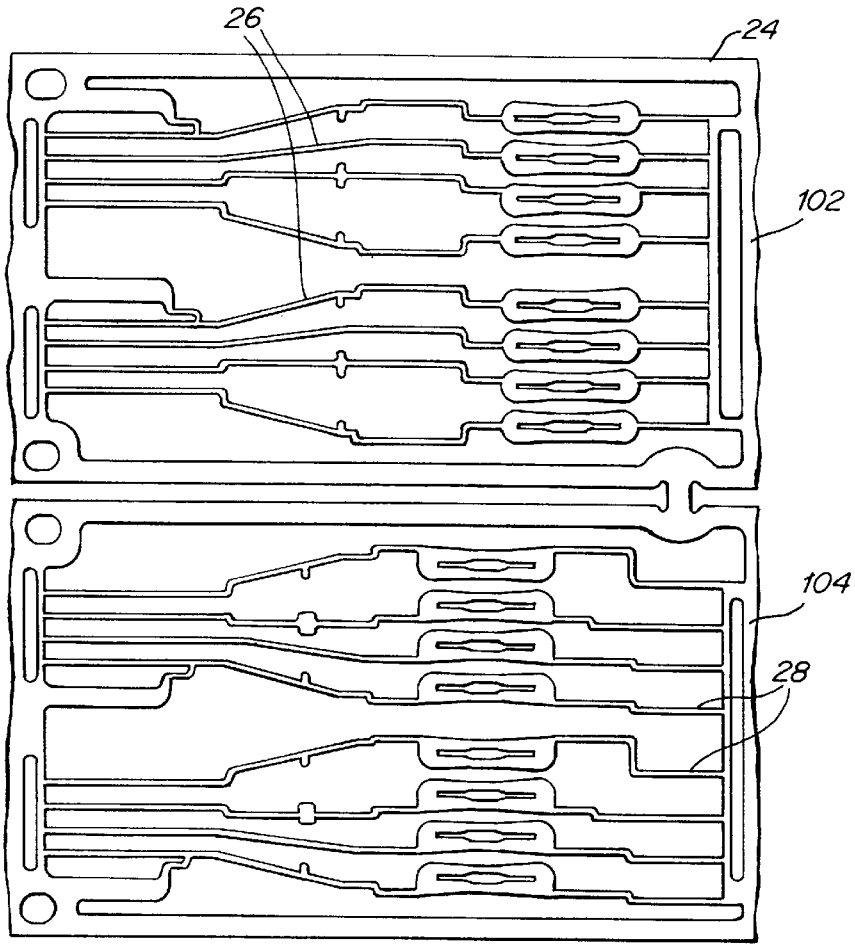
FIG. 4 is a plan view of a section of a punched strip member used to form the leads of the connector element of FIG. 1.

According to this embodiment of the connector element illustrated in FIGS. 2 and 3, the leads are disposed and arranged in two superimposed layers. Referring to FIG. 4, there is illustrated a plan view of the leads which are made from two punched strip members 102, 104, each having four leads 100. In particular, according to this embodiment of the connector element, a section of a bronze strip 24, is punched, repeatedly, to form two adjacent bottom layers 26 and two adjacent top layers 28. These layers 26, 28 are then subjected to spatial shaping for the formation of the wire connection terminals 6 including the raised portions 18, 20 of the leads 100. Thereafter, the two layers are consecutively superimposed as illustrated in the top view of the laid together leads in FIG. 5, and fed to an injection molding machine, in which they are provided within the block member 4 as illustrated in FIG. 1. It is to be appreciated that although this embodiment of the connector element has been illustrated with two layers of leads, it is to be understood that the connector element of the invention can have more than two layers of leads and that such modifications of the connector element that are readily apparent to one of skill in the art are intended to be within the scope of the invention. The resulting connector element is shown in a more detailed view in FIG.

9, where the contact terminals 2 are shown protruding from the block member 4 horizontally and with their outer ends interconnected by an integral cross strip 3 in each layer. After the molding of the block 4, these strips are cut off and the springs are bent over as illustrated in FIG. 1. From FIG. 9 it is apparent that some lead portions, designated 32, are exposed in the block member 4. Such exposed areas also occur at the underside of this body, with a view to the optimizing of the dielectric coverage of the leads at any place thereof.

Figure 10:
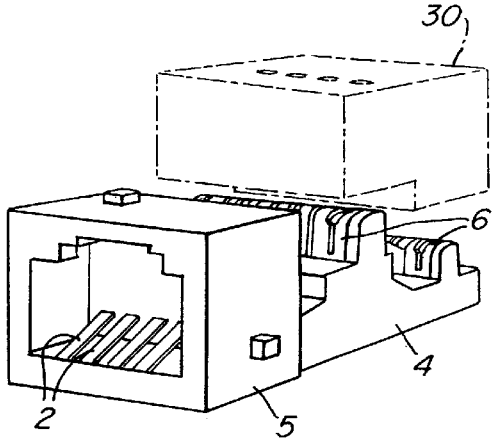
FIG. 10 is a perspective view of the connector element of FIG. 1, as assembled.
Figure 11:
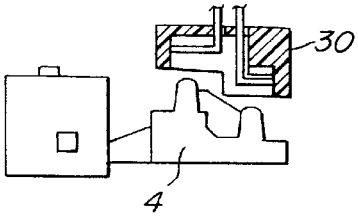
FIG. 11 is a sectional view of the connector element of FIG. 10.

Thereafter, as shown in FIG. 10, the connector element is provided with a front frame member 5, which is secured by snap locking into non-illustrated apertures in the underside of the foremost flat portion of the block member 4. With this arrangement, it is possible to mount all the wires of the telecommunications cable to respective wire connector terminals by a single press-cap, if the wire connector terminals are of the type provided with upwardly open notches for receiving the wire ends and cutting into the sides of these wire ends. As illustrated in dotted lines, a press-cap member 30 may be pressed onto the block 4 and, according to known principles, may facilitate the mounting of the ends of isolated connector wires disposed in the press-cap member, within the self-cutting type of wire connector terminals 6. For such a mounting according to predefined terminal wiring assignments for modular plugs and jacks, the straight wire ends are inserted into orderly arranged holes at the rear side of the press-cap member, such that the wire ends would automatically be pressed down into the correct wire connector terminals when the cap is pressed down. However, because the electrical conditions are very critical, instead of prescribing such a mounting as illustrated by wire pair A shown in dot-and-dash lines in FIG. 6, it has been found better to arrange the wires so that the end of the wire vertically engages the wire connector terminals as shown by the wire pair B in FIG. 6, or in other words, through the top of the press-cap 30. The reason is that the horizontally disposed wires as illustrated by A, particularly the uppermost wires, form loops together with the leads 100 of the connector. However, it will be noted from FIG. 6 that the areas of these loops will be considerably smaller for the vertically disposed wires B than for the horizontally disposed wires A. Accordingly, according to this embodiment of the connector element of the invention, the vertically disposed wires B are mounted in the press-cap as shown in FIG. 11.

Figure 7:
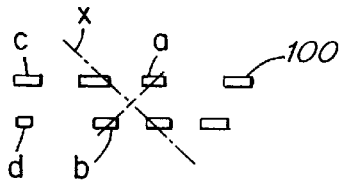
FIGS. 7 and 8 are cross sectional views showing different spatial positions of the leads of the connector element of FIGS. 2–3.
Figure 8:
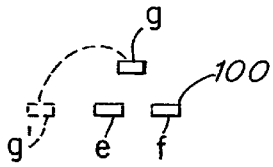
Figure 9:
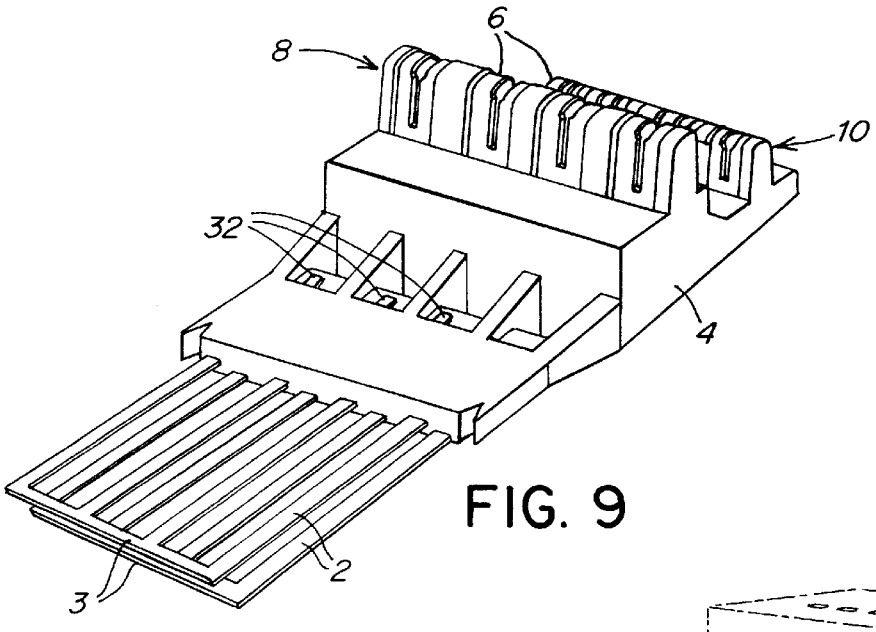
FIG. 9 is a perspective view of the connector element of FIG. 1, showing the connector element in a more detailed manner.

In the embodiment of the connector element shown in FIGS. 1–11, the connector element is made according to a specific pre-defined standard, according to which the different wire-connector terminals as numbered 1–8 in FIG. 3 are used in pairs for different circuits; these pairs being defined by the following terminals: 1–2; 4–5; 3–6; and 7–8. Referring to FIGS. 7–8, which are cross-sectional views of different spatial dispositions of the leads of the connector element, it can be seen that for at least one of these pairs it is the case that the associated leads 100 will be located one above the other, such as, for example, as the leads labeled c, d in FIG. 7. These leads will have a field axis located in a horizontal plane. The field axis is located perpendicular to a common plane containing the leads. In contrast, as is illustrated in FIG. 7, where the two leads a and b are not located one directly above the other, but instead are disposed laterally with one lead a in a first plane and a second lead b in a second plane below the first plane, these leads form a coil portion having a field axis x that is not horizontal. These field orientations are significant to reducing and/or optimizing the mutual inductance between the wire pairs.

It is to be understood that a feature of the leads of the connector element of the invention is that even though they are constrained to run between the tightly disposed contact terminals and the wire connector terminals, the leads are spaced and arranged within the connector element to optimize the performance of the connector element and the overall connector. With the spatial arrangement of the leads of the invention, the distance between the leads 100 is largely increased, thereby decreasing the capacity and mutual inductance between the leads and thereby enabling optimization of the capacity and mutual inductance of the leads. With this arrangement, it is also possible to use leads of varying width in order to optimize the inductance of the leads for the desired result.

In particular, there is to be balanced the capacity between the leads 100, both of single pairs and different pairs. Generally, the open structure of the connector element reduces capacities between the leads, but still there is a need for further reducing them between some leads and for even increasing capacities between other leads. According to the invention, the capacity can be optimized with this spatial structure of the leads of the invention, as is now explained with reference to FIG. 8:

FIG. 8 shows three leads e, f and g arranged in a spatial, triangular pattern. Compare the leads of the connector element of FIG. 8 with a corresponding known flat arrangement of the leads, with lead g located in the position marked g'. In the known arrangement, the capacity between g' and e, as well as between e and f, may be satisfactory, while it could be desired to increase the capacity between g' and f. In the known planar arrangement, this increase in capacity will be practically impossible without adversely affecting the other capacities. However, with the spatial arrangement of leads according to the invention, the lead g' is swung along a circle centered at e, such that it will maintain its capacity to e while increasing its capacity to f. Thus, in the position g illustrated in FIG. 8, the lead still has the desired capacity to e and its capacity to f can be increased as desired. Correspondingly, if it is desired to decrease the capacity between e and f, without changing the capacity between g' and e, then the lead e could be swung about a circle centered at g', away from f. Additionally, e may be arranged closer to or further from g' for changing this capacity. Furthermore, the widths of the leads may be changed to not only modify their inductance, but also to influence the capacities.

Figure 5:
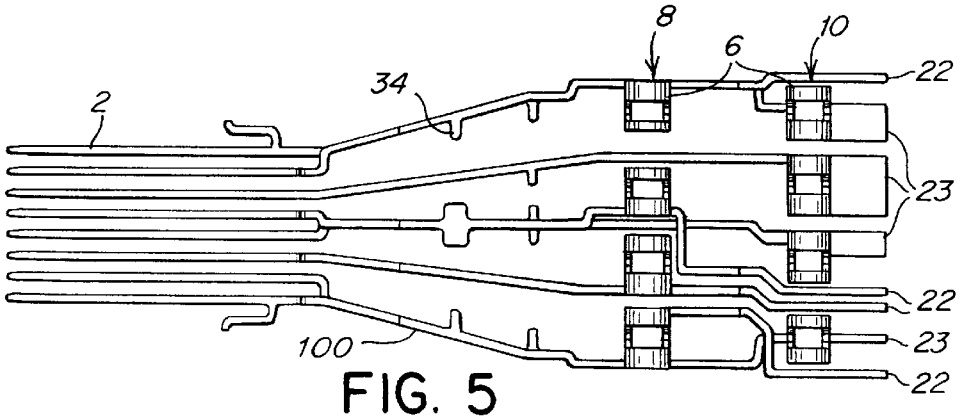
FIG. 5 is a top view of the leads of FIG. 4, when laid together.

Accordingly, it is a feature of the spacial arrangement of the leads of the connector element of the invention, that once at least one of the leads 100 is disposed above that of an underlying lead 100 as, for example, at the bent-up lead portions 14 (See FIG. 2), there will be a lateral displacement along the length of one of these leads, not only for forming a nonhorizontal loop as already described, but also, that is for additionally or alternatively for adjusting relevant capacities with neighboring leads. According to the spatial arrangement of the leads of the invention, the leads 100 may even cross each other in different planes. As is clear from FIG. 5, it has been found advantageous and possible to let the leads extend predominantly in pairs with the leads located one directly above the other. As illustrated in FIG. 5, in this embodiment of the connector element there are five lead paths due to uneven horizontal spacing between leads in the two layers. FIG. 5 also illustrates a variation of this embodiment of the connector element, wherein the rear portions 22, 23, of the leads are of different widths.

Thus, it is to be appreciated that with the connector element of the invention it is possible to maintain a desired distance between two neighboring leads in the connector, while at the same time it is possible to bring more closely together two non-neighboring leads for increasing the capacity between them. With the connector element of the invention it is also possible to change the direction of the coil axis to, for example, to an inclined cross-direction, by arranging leads belonging to a same inductance loop to be located one above the other, and also staggered in the transverse direction along the length of the connector element. The mutual inductance of the connector element can be largely affected and controlled in this manner. In addition, with this arrangement, the inductance of each of the leads can also be adjusted, because once the leads are brought into a three-dimensional pattern, the widths of the leads can also be varied somewhat without major influence on the capacities.

Of course, the capacity, the inductance and the mutual inductance values are highly interrelated in the structure, but according to the invention, it has been found possible to dispose and arrange the leads in such a manner that the electrical effects of the connector elements are minimized, thereby causing minimal disturbance in the signal transmission through the connector element, even at very high transmission capacities. In addition, according to another embodiment of the invention, it has been found that the leads of the connector element can be constructed and arranged not only to minimize and/or optimize the capacitance, the inductance and the mutual inductance of the leads, but also the leads can be disposed and arranged so as to offset any coupling between the leads introduced by the mating connector element of the connector. In particular if, for example, the plug of the connector introduces some amount of coupling between its leads, this coupling can be offset and its effects can be balanced out in the mating jack so that the combined plug and jack (connector) has an idealized electrical performance. In particular, by constructing and arranging the leads on one connector element to balance out the coupling introduced by the mating connector element, the overall connector can be provided with minimal cross-talk between the leads of the connector and thus improved cross-talk performance.

One problem is that measuring the cross-talk between the leads of the connector is impractical. Thus, the present invention includes a method of optimizing the electrical transfer function of the communications network connector. The method includes measuring the return loss of the communications network connector at, for example, one end of the connector element, and spacing and arranging the leads both laterally and vertically so as to optimize the return loss of the communications network connector and so as to offset any coupling introduced by the mating connector element counterpart. In particular, by optimizing the return loss of the communications network connector, the communications network connector is provided with an optimized return loss, an optimized insertion loss and an optimized cross-talk performance.

Once the detailed structure of the lead system of the connector element of the invention has been determined and reduced to practice, i.e. stamped out and spatially shaped, it will normally be a very delicate matter to transfer the lead structure to a die casting machine, since the accuracy requirements will be extremely high. Thus, deviations or deformations of hundredths of a millimeter may make the connector unusable for a qualified purpose. Accordingly, according to another embodiment of the connector element of the invention, the lead system is provided with various portions such as protrusions 34, as illustrated in FIG. 3, and rear extensions 20, 22 from the upper row of wire connection terminals 6, such that these portions can be gripped by a suitable transfer apparatus. The presence of these electrically non-required portions calls for special attention in the design of the connector element, because they inevitably affect at least some of the operationally relevant parameters.

It is to be appreciated that the connector element shown in FIGS. 1–11 is a female jack or socket member for receiving a counterpart connector element or plug with rigid connector terminals. It will be understood that such a plug may be designed using the same spacial arrangement as the above-described jack connector element or at least according to the same principles with respect to the spatial arrangement of the leads, and that such a plug connector element is intended to be within the scope of the invention.

FIGS. 12A–12B, 13A–13B, 14A–14B, 15A–15B, and 16A–16B illustrate additional embodiments of connector elements according to this invention. Each of these figures illustrates a front perspective view and a side view of a respective embodiment of connector element according to the invention. It is to be appreciated that common components of the connector element have been illustrated with like reference numbers and that the above description with respect to the like reference number and the advantages of the connector element and overall connector applies to these embodiments also.

Figure 12A:
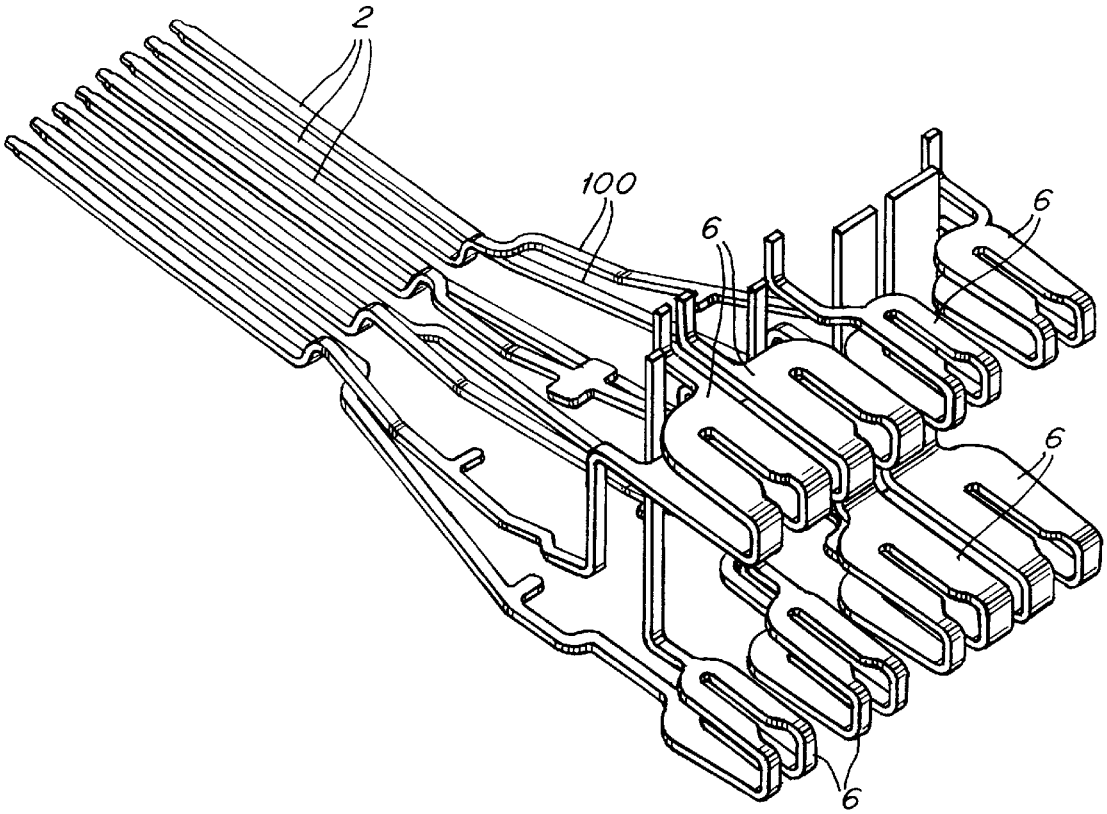
FIG. 12A is an enlarged perspective view of the leads of another embodiment of a connector element according to the present invention.
Figure 12B:
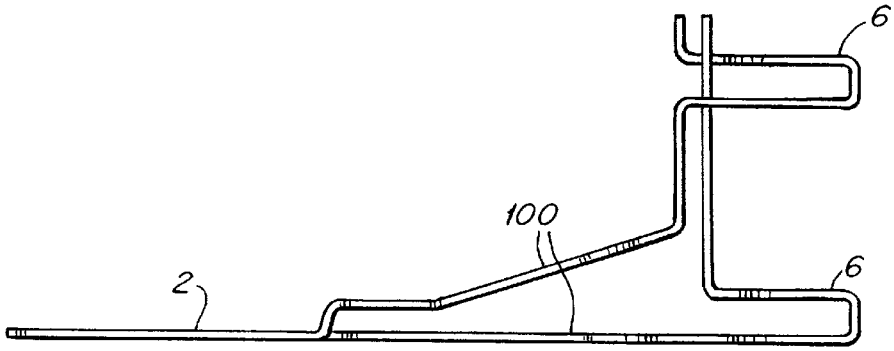
FIG. 12B is a side view of the leads of the connector element of FIG. 12A.
Figure 13A:
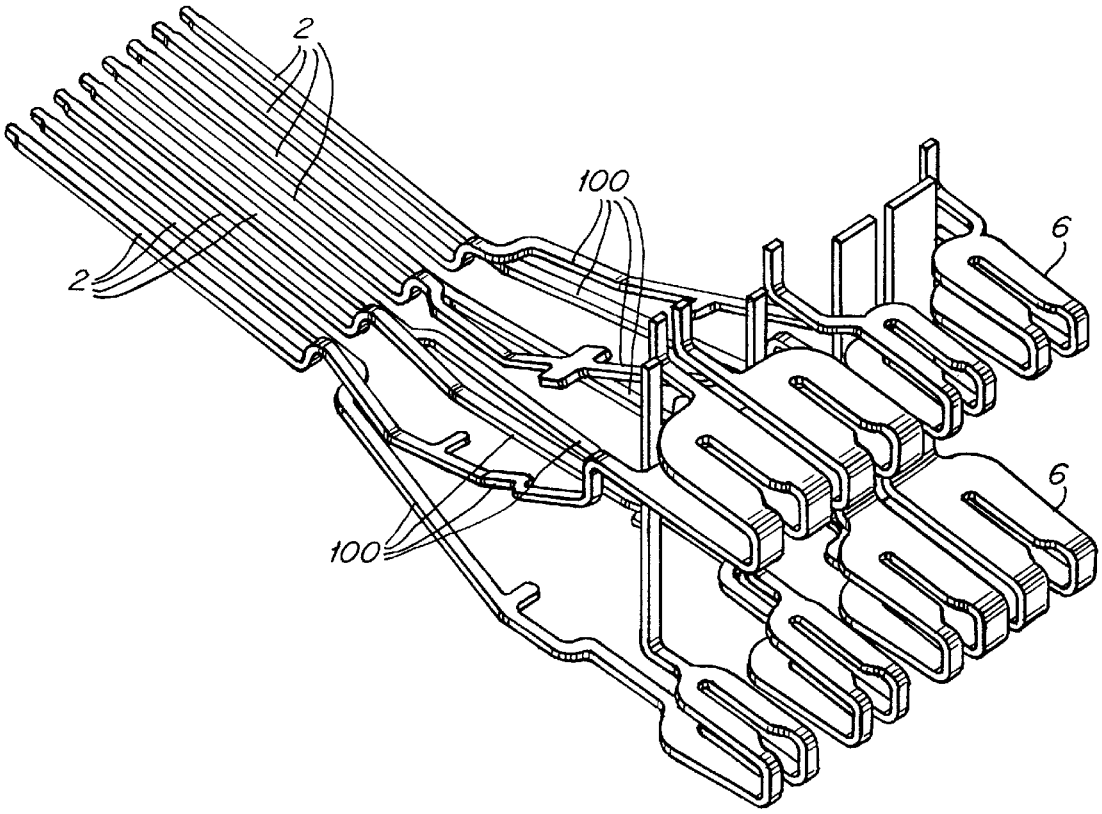
FIG. 13A is an enlarged perspective view of the leads of another embodiment of a connector element according to the present invention.
Figure 13B:
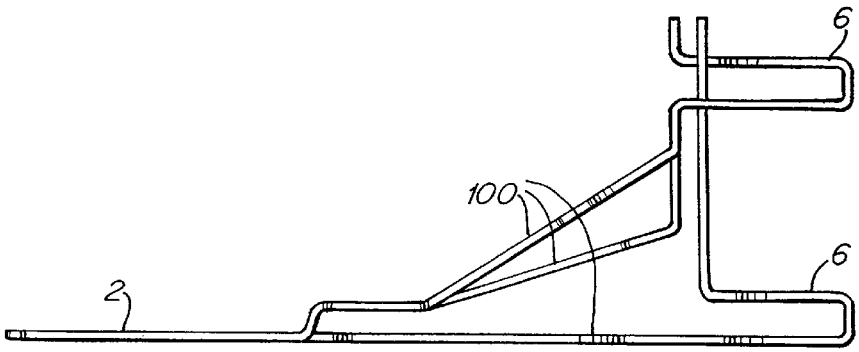
FIG. 13B is a side view of the leads of the connector element of FIG. 13A.

FIGS. 12A–12B illustrate an embodiment of a connector element according to the present invention, wherein the inverted, U-shaped wire connector terminals 6 are oriented in a horizontal manner, parallel to the direction of contact terminals 2. The leads 100 of this embodiment are disposed in substantially two planes. FIGS. 13A–13B illustrate an embodiment of a connector element according to the present invention substantially similar to that in FIG. 12, except that the leads 100 of this embodiment are oriented in three planes. Two of the planes of this embodiment are transverse to the standardized group of contact terminals 2.

Figure 14A:
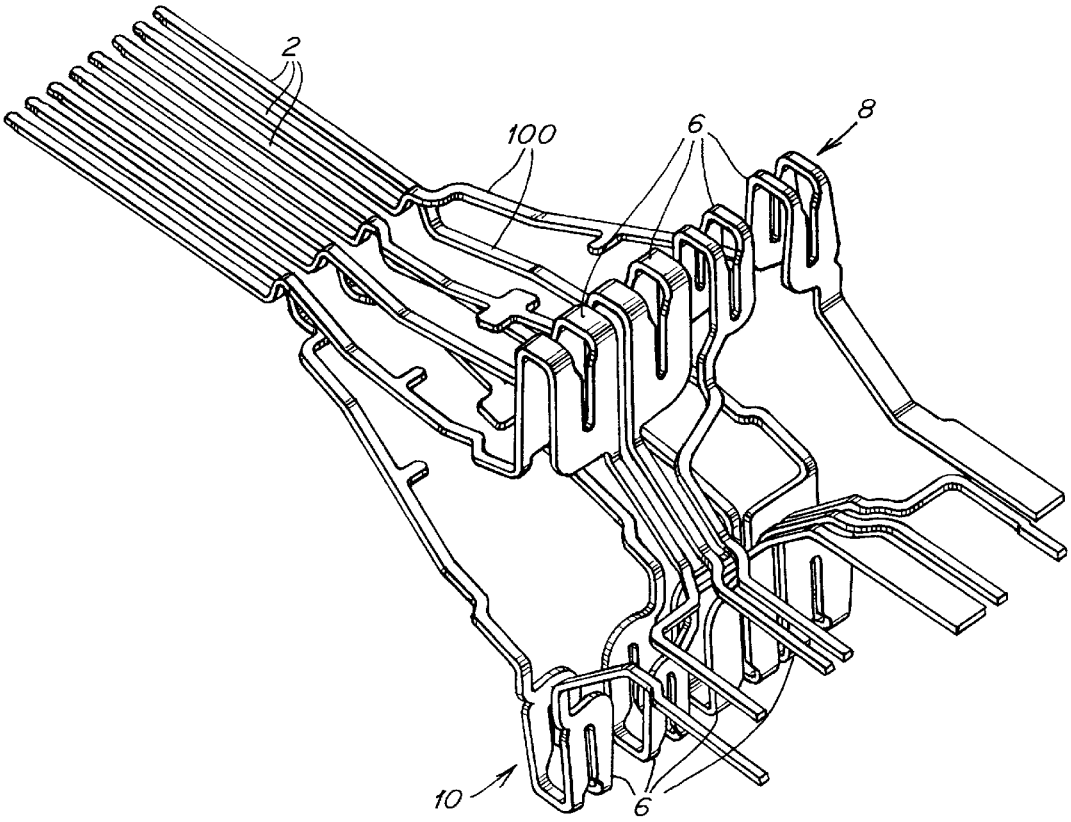
FIG. 14A is an enlarged perspective view of the leads of another embodiment of a connector element according to the present invention.
Figure 14B:
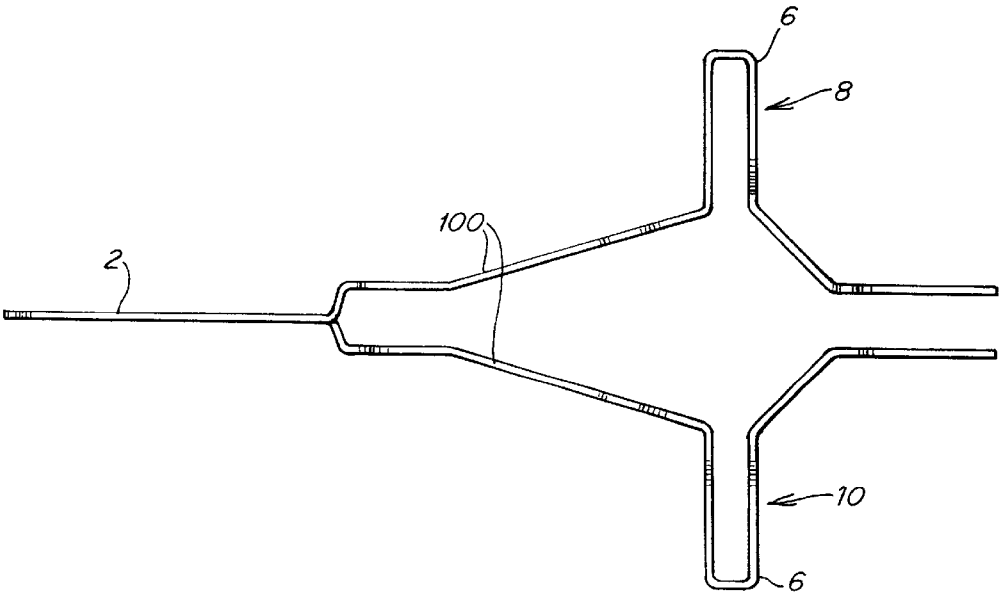
FIG. 14B is a side view of the leads of the connector element of FIG. 14A.
Figure 15A:
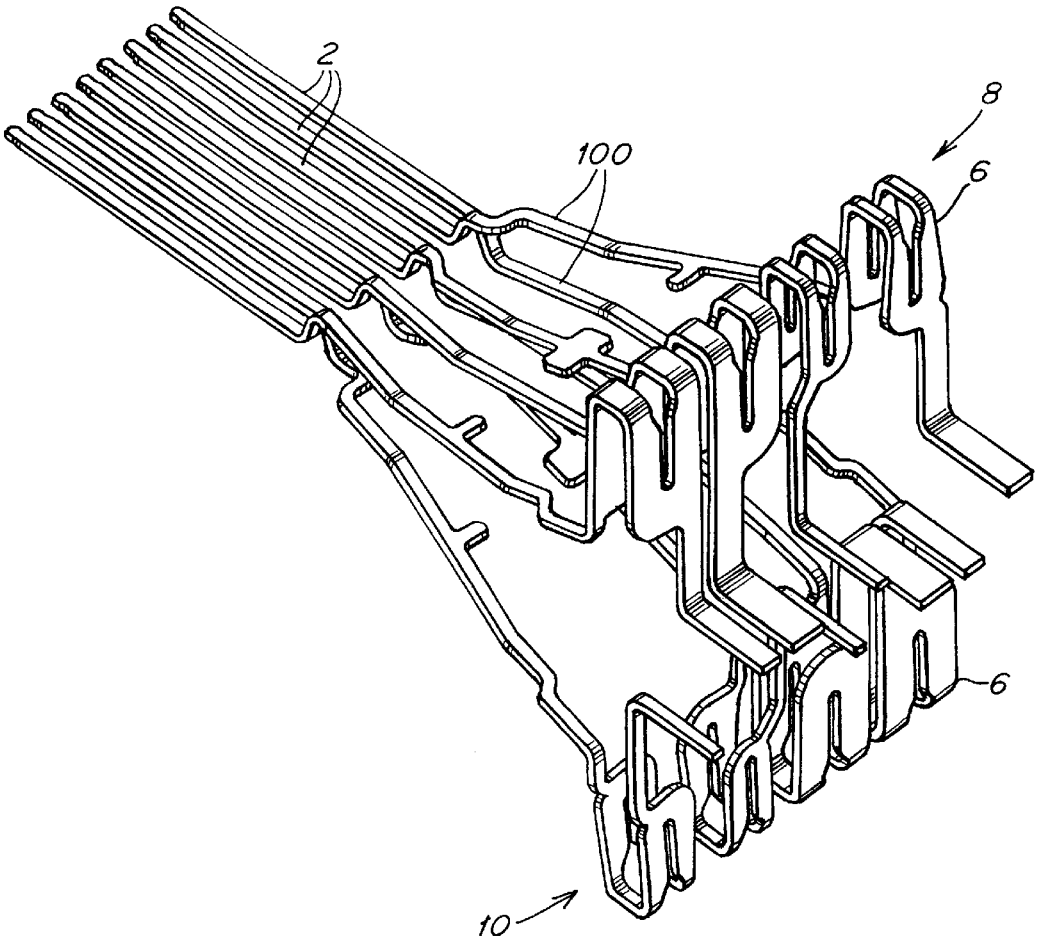
FIG. 15A is an enlarged perspective view of the leads of another embodiment of a connector element according to the present invention.
Figure 15B:
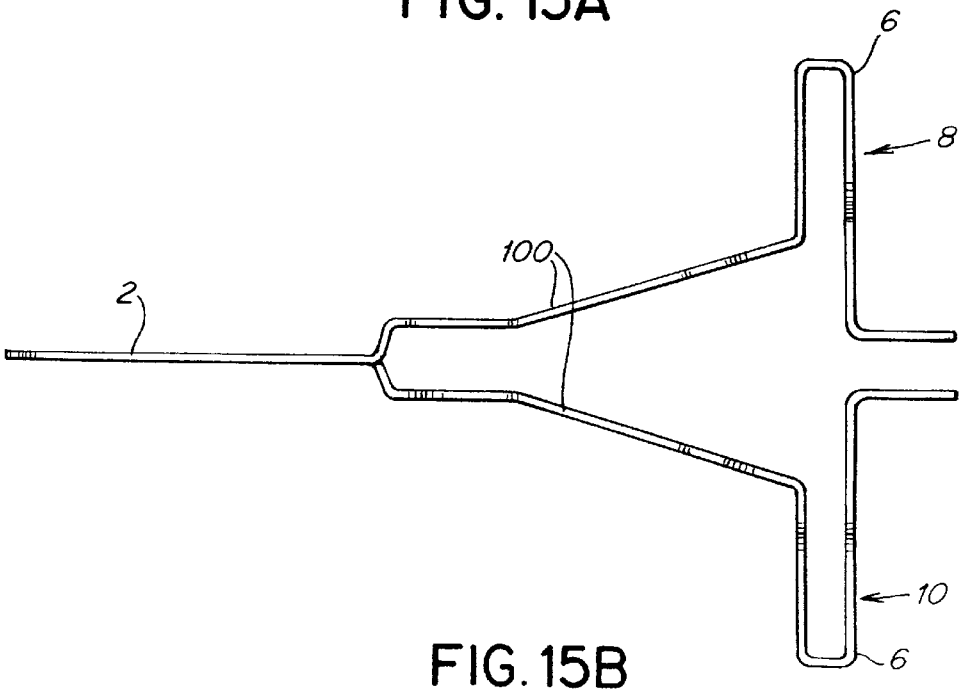
FIG. 15B is a side view of the leads of the connector element of FIG. 15A.

FIGS. 14A–14B illustrate an embodiment of a connector element according to the present invention, wherein the inverted, U-shaped wire connector terminals 6 are oriented in an upwardly facing row 8 and a downwardly facing row 10. The row 8 of wire-connector terminals is disposed above the row 10 of wire-connector terminals. FIGS. 15A–15B illustrate an embodiment of a connector element of the present invention substantially similar to that in FIGS. 14A–14B, except that in this embodiment there is a variation in the projections 22, 23, that extend from the rows 8, 10 of wire connector terminals, that may be used to adjust the inductance and capacitance of the connector element.

Figure 16A:
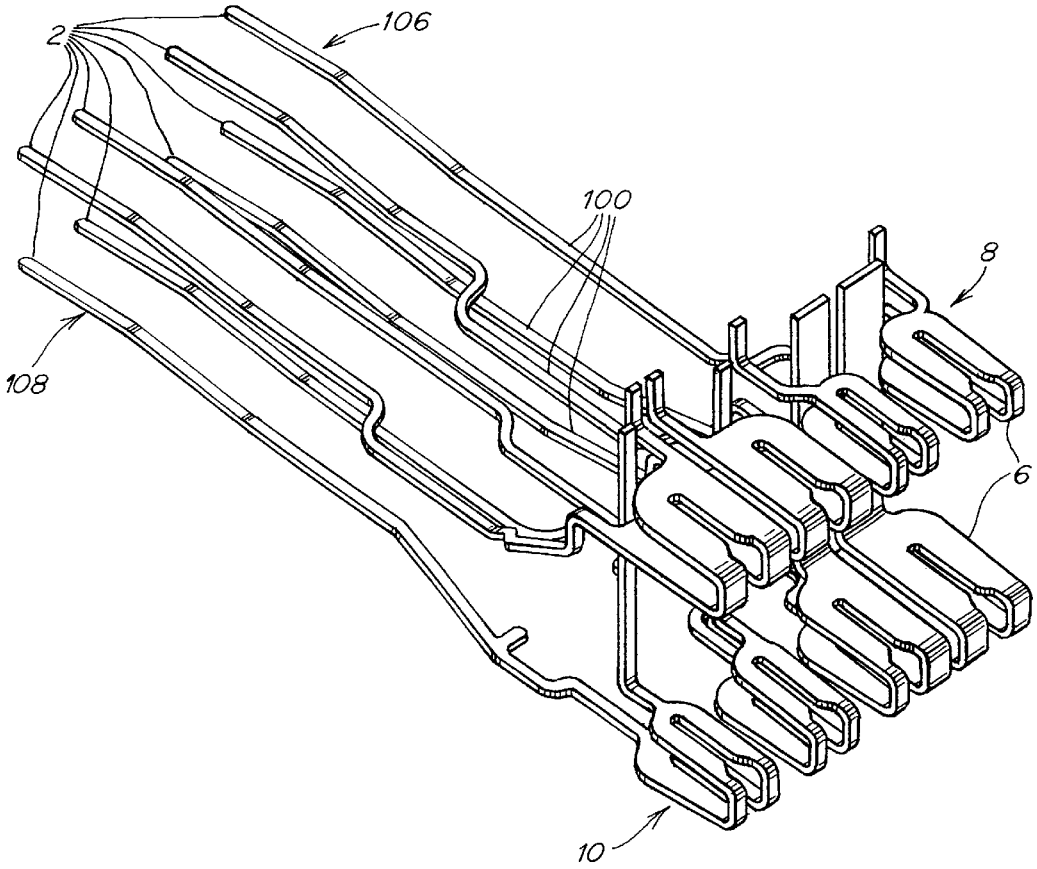
FIG. 16A is an enlarged perspective view of the leads of another embodiment of a connector element according to the present invention.
Figure 16B:
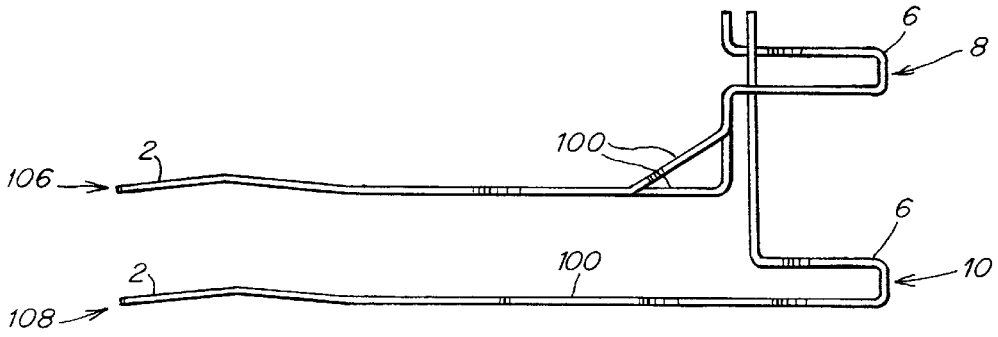
FIG. 16B is a side view of the leads of the connector element of FIG. 16A.

FIGS. 16A–16B illustrate another embodiment of a connector element according to the present invention, wherein the contact terminals 2 are oriented in two horizontal planes 106, 108 and the inverted, U-shaped wire connector terminals 6 are orientated in a horizontal manner in two rows 8, 10. The leads between the contact terminals 2 and the row 10 of wire connector terminals are in parallel in a first horizontal plane 108, and the leads 100 between the contact terminals 2 and the row 8 of wire connector terminals 6 are disposed substantially in parallel in a second horizontal plane 106. The orientation of contact terminals 2 is an example of one of the many configurations possible for standardized groups of contact terminals 2. It is to be appreciated that the structure of the connector element of the invention is to be closely linked with the already established standards such as, for example, the preestablished standard for rows of contact terminals and wire connector terminals. However, it is to be appreciated that as such standards change, the connector elements according to the invention may be adapted to other standards.

It is also to be appreciated that many modifications to the connector element of the invention will be possible within the spirit and scope of the invention. From a practical point of view it is desirable that the leads in the lower level extend in a common plane also comprising the originally punched-out contact terminals 2, as illustrated in the embodiments of FIGS. 1–2, 12, 13 and 16. However, as is illustrated in the embodiments of the connector element of FIGS. 14–15, it is possible that these leads or some of them might extend upwardly or downwardly. The same is true for the upper leads, which need not necessarily be located in a common plane as is illustrated in FIGS. 2–3, and 12–15. Even the wire connection terminals 6 need not be provided with uniform spacing, in a line or level with each other; for the electrical adaptation there could be good reasons for arranging them otherwise. However, it will be appreciated that it is practical to have the wire connector terminals arranged in rows. Thus, it is highly advantageous that with the spatial arrangement of the leads of the invention, that these wire-connector terminals, which are potential high-capacity units, can be separated in the longitudinal direction, while in the transverse direction they can be allowed to have a mechanically required width without making the entire width of the connector element excessive. It is another advantage of spacial arrangement of the leads of the connector element, that the wire-connector terminals in the rows may be non-uniformly interspaced, and two or even more rows of wire connection terminals may thus be provided.

Having thus described several particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. A connector element for making a connection between electrical conductors in a high frequency communications network, the connector element having a front, a rear and a length between the front and the rear, the connector element comprising:

a plurality of contact terminals arranged in at least one plane at the front of the connector element, the plurality of contact terminals being configured for connection with corresponding terminals of a mating connector element;

a plurality of wire connector terminals disposed in two rows at substantially the rear of the connector element;

a plurality of leads, each lead connecting a corresponding wire connector terminal with a corresponding contact terminal, the plurality of leads being disposed and arranged in a three-dimensional manner such that some of the leads are spaced laterally away from each other along the length of the connector element, and such that some of the leads are spaced vertically along the length of the connector element so as to optimize the electrical performance of the connector element; and a block member of a dielectric material enclosing the leads and holding the leads of the connector element in the three-dimensional manner.

2. The connector element according to claim 1, further comprising the mating connector element so that the connector element and mating connector element together comprise a connector for a high-frequency communication network.

3. The connector element according to claim 1, wherein the wire connector terminals have non-uniform spacing between the wire connector terminals.

4. The connector element according to claim 1, further comprising a press-cap having a plurality of through-lets to receive respective wire ends to be mounted in corresponding notches in the wire connector terminals, such that by a press-down operation of the press-cap over the wire connector terminals to a mounted position of the press-cap on the connector element, the respective wire ends are disposed in the corresponding notches of the wire connector terminals.

5. The connector element according to claim 1, wherein portions of leads are exposed on a surface of the block member.

6. The connector element according to claim 1, wherein a first row of wire connector terminals is disposed in a first plane above a second row of wire connector terminals disposed in a second plane.

7. The connector element according to claim 6, wherein the second row of wire connector terminals is disposed at substantially the rear of the connector element, and the first row of wire connector elements is disposed along the length of the connector element between the second row and the contact terminals.

8. The connector element according to claim 7, wherein some of the leads extend in a horizontal plane from the contact terminals to the second row of wire connector terminals and divert from each other along the length of the connector element, and wherein a remainder of the leads extend upward and in a diverging manner from the horizontal plane containing the contact terminals to the first row of wire connector terminals.

9. The connector element according to claim 6, wherein some of the leads extend in a horizontal plane from the contact terminals to the second row of wire connector terminals and divert from each other along the length of the connector element, and wherein a remainder of the leads extend upward in a diverging manner from the horizontal plane containing the contact terminals along the length of the connector element to the first row of wire connector terminals.

10. The connector element according to claim 9, wherein the first row of wire connector terminals is disposed directly above the second row of wire connector terminals.

11. The connector element according to claim 10, wherein the first row and the second row of wire connector terminals have inverted, U-shaped notches disposed therein, that are oriented in to the horizontal direction of the first plane and the second plane.

12. The connector as claimed in claim 6, wherein some of the leads extend from the contact terminals in an upward direction and in a diverging manner to the first row of wire connector terminals, and a remainder of the leads extend from the contact terminals in a downward direction and in a diverging manner to the second row of wire connector terminals.

13. The connector element according to claim 12, wherein the first row of wire connector terminals is disposed above the second row of wire connector terminals.

14. The connector element according to claim 13, wherein the first row and the second row of wire connector terminals have inverted, U-shaped notches disposed therein, the inverted, U-shaped notches in the first row of wire connector terminals being oriented in the upward direction and the inverted, U-shaped notches in the second row of wire connector terminals being oriented in the downward direction.

15. The connector element according to claim 1, wherein the contact terminals are disposed in two horizontal planes.

16. The connector element according to claim 15, wherein the at least one plane of wire connector terminals includes a first row of wire connector terminals disposed directly above a second row of wire connector terminals.

17. The connector element according to claim 16, wherein some of the leads extend in a substantially parallel manner from the contact terminals in a first plane of contact terminals to the wire connector terminals in the second row of wire connector terminals, and a remainder of the leads extend from a second plane of contact terminals, that is disposed above the first plane of contact terminals, in a substantially parallel manner to the first row of wire connector terminals.

18. The connector element according to claim 17, wherein the first row and the second row of wire connector terminals have inverted, U-shaped notches disposed therein, and wherein the inverted, U-shaped notches are oriented in the horizontal direction.

19. A connector element for use in high frequency communication networks, comprising:

a standardized group of contact terminals disposed at a first end of the connector element that are disposed and arranged for connection with corresponding terminals of a mating connector element counterpart;

a plurality of wire connector terminals disposed in two rows at substantially a second end of the connector element; and a plurality of leads, each lead connecting a respective contact terminal to a corresponding wire connector terminal, wherein the plurality of leads are spaced both laterally and vertically along a length of the connector element and the leads are shaped and arranged so as to optimize an electrical transfer function of a connector element made up of the connector element and the mating connector element counterpart.

20. The connector element according to claim 19, wherein the plurality of leads are disposed in a block member of a dielectric material.

21. The connector element of claim 19, wherein the standardized group of contact terminals is disposed and arranged as a linear row of contact terminals.

22. The connector element according to claim 19, further comprising the mating connector element counterpart that mates with the connector element to form the connector, wherein the electrical transfer function is optimized to minimize the return loss of the connector, to thereby offset any coupling introduced by the mating connector element counterpart and to thereby provide the connector having minimized cross-talk between the leads of the connector.

23. The connector element according to claim 22, wherein a first row of the two rows of wire connector terminals is disposed above a second row of the two rows of wire connector terminals.

24. The connector element according to claim 23, wherein the first row of wire connector terminals and the second row of wire connector terminals have inverted, U-shaped grooves disposed in a horizontal manner.

25. The connector element of claim 23, wherein the first row of wire connector terminals has inverted, U-shaped grooves disposed in an upward manner, and a second row of wire connector terminals has inverted, U-shaped grooves disposed in a downward manner, the first row being disposed above the second row.

26. The connector element according to claim 23, wherein the second row of wire connector terminals is disposed at substantially the second end of the connector element, and the first row of wire connector elements is disposed along the length of connector element between the second row of wire connector terminals and the contact terminals.

27. The connector element according to claim 26, wherein some of the leads extend in a horizontal plane from the contact terminals to the second row of wire connector terminals and laterally divert from each other along the length of the connector element, and wherein a remainder of the leads extend upward and in a diverging manner from the horizontal plane containing the contact terminals and along the length of the connector element to the first row of wire connector terminals.

28. The connector element according to claim 23, wherein some of the leads extend in a horizontal plane from the contact terminals to the second row of wire connector terminals and laterally divert from each other along the length of the connector element, and wherein a remainder of the leads extend upward in a diverging manner from the horizontal plane containing the contact terminals and along the length of the connector element to the first row of wire connector terminals.

29. The connector element according to claim 28, wherein the first row of wire connector terminals is disposed above the second row of wire connector terminals.

30. The connector element according to claim 29, wherein the first row and-the second row of wire connector terminals have inverted, U-shaped notches that are disposed in a horizontal direction.

31. The connector as claimed in claim 23, wherein some of the leads extend from the contact terminals in an upward direction and in a diverging manner to the first row of wire connector terminals, and a remainder of the leads extend from the contact terminals in a downward direction and in a diverging manner to the second row of wire connector terminals.

32. The connector element according to claim 31, wherein the first row of wire connector terminals is disposed above the second row of wire connector terminals.

33. The connector element according to claim 32, wherein the first row of wire connector terminals has inverted, U-shaped notches oriented in the upward direction and the second row of wire connector terminals has inverted, U-shaped notches oriented in the downward direction.

34. The connector element according to claim 23, wherein the plurality of leads are disposed in a block member of a dielectric material.

35. The connector element according to claim 34, wherein the first row and the second row of wire connector terminals have inverted, U-shaped notches disposed therein and oriented in the horizontal direction.

36. The connector element of claim 19, wherein the plurality of leads are disposed and arranged in at least two planes, one of the at least two planes being the plane containing the standardized group of contact terminals.

37. The connector element of claim 36, wherein another of the at least two planes is transverse to the plane containing the standardized group of contact terminals.

* * * * *

UNITED STATES PATENT AND TRADEMARK OFFICE

CERTIFICATE OF CORRECTION

PATENT NO. : 6,102,730
DATED : August 15, 2000
INVENTOR(S) : Kjeldahl et al.

It is certified that error appears in the above-identified patent and that said Letters Patent is hereby corrected as shown below:

On the front page, item [63]:

U.S. Application No. 09/188,984, filed November 9, 1998, is a continuation-in-part application of U.S. Application No. 08/530,266, filed September 1, 1995, which issued as U.S. Patent No. 6,113,418 on September 5, 2000.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*